US007408542B2

(12) United States Patent
Gagnot et al.

(10) Patent No.: US 7,408,542 B2
(45) Date of Patent: Aug. 5, 2008

(54) METHOD OF GENERATING AN ADDRESS SIGNAL IN A PLASMA PANEL AND DEVICE FOR IMPLEMENTING SAID METHOD

(75) Inventors: Dominique Gagnot, Charavines (FR); Gérard Rilly, St Etienne Crossey (FR); Ana Lacoste, St Martin le Vinoux (FR)

(73) Assignee: Thomson Licensing, Boulogne Billancourt (FR)

( * ) Notice: Subject to any disclaimer, the term of this patent is extended or adjusted under 35 U.S.C. 154(b) by 574 days.

(21) Appl. No.: 10/909,913

(22) Filed: Aug. 2, 2004

(65) Prior Publication Data

US 2005/0068260 A1 Mar. 31, 2005

(30) Foreign Application Priority Data

Jul. 31, 2003 (FR) ..... 03 09418

(51) Int. Cl.
*G09G 3/28* (2006.01)

(52) U.S. Cl. ..... 345/211; 345/212; 345/213; 345/60; 315/169.1

(58) Field of Classification Search ..... 345/211, 345/212, 213; 315/169
See application file for complete search history.

(56) References Cited

U.S. PATENT DOCUMENTS 4,866,349 A * 9/1989 Weber et al. ..... 315/169.4
6,333,738 B1 * 12/2001 Ide ..... 345/211
6,366,063 B1 * 4/2002 Sekii ..... 323/223
6,943,757 B2 * 9/2005 Huang et al. ..... 345/60
7,078,866 B2 * 7/2006 Choi ..... 315/169.4
7,145,522 B2 * 12/2006 Yamamoto et al. ..... 345/60
7,166,967 B2 * 1/2007 Cho et al. ..... 315/169.3

FOREIGN PATENT DOCUMENTS

WO WO 99/12149 3/1999
WO WO 03/058591 7/2003

* cited by examiner

*Primary Examiner*—Bipin Shalwala
*Assistant Examiner*—Afroza Y Chowdhury
(74) *Attorney, Agent, or Firm*—Joseph J. Laks; Harvey D. Fried

(57) ABSTRACT

The method of the invention generates an address signal for addressing columns or rows of a PDP. In the case of addressing a column, for example, the method comprises the following steps.

For a phase T1, a DC voltage V1 is applied across the terminals of a solenoid L, so that the latter stores energy, and applies a voltage A across the terminals of a selected column.

During a phase T2, some of the energy stored in the solenoid L is discharged into the column until the voltage across the terminals of the column becomes about zero.

During a phase T3, an approximately zero voltage is maintained across the terminals of the column. According to one embodiment the selection of the column(s) during this phase is modifiable.

During a phase T4, the solenoid L is charged with current stored in a capacitor until the voltage across the terminals of the column is zero.

7 Claims, 9 Drawing Sheets

METHOD OF GENERATING AN ADDRESS SIGNAL IN A PLASMA PANEL AND DEVICE FOR IMPLEMENTING SAID METHOD

This application claims the benefit, under 35 U.S.C. § 119 of French Patent Application 0309418, filed Jul. 31, 2003.

FIELD OF THE INVENTION

The invention relates to a method and a device for for addressing columns or rows of a plasma display panel.

BACKGROUND OF THE INVENTION

At the present time, there are various types of AC plasma panel (hereafter called PDP), namely those that use only two crossed electrodes to define a cell, as described in Patent FR 2 417 848, and those of the "coplanar sustain" type, known especially from the European Patent document EP-A-0 135 382, in which document each cell is defined at the intersection of a pair of electrodes, called "sustain electrodes", and of one or more other electrodes, called "column electrodes", used more particularly for addressing the cells. The present invention will be more particularly described within the context of an AC-PDP of the coplanar sustain type without it being possible in any way to be limited to this type of panel.

SUMMARY OF THE INVENTION

The invention provides method and a device for supplying the columns or rows of a PDP during the phase of addressing its cells with a smaller number of switches so as to reduce the fabrication costs of the device.

BRIEF DESCRIPTION OF THE DRAWINGS

The invention will be more clearly understood and other features and advantages will become apparent on reading the description that follows, the description being given with reference to the appended drawings, in which.

DESCRIPTION OF PREFERRED EMBODIMENTS

Figure 1:
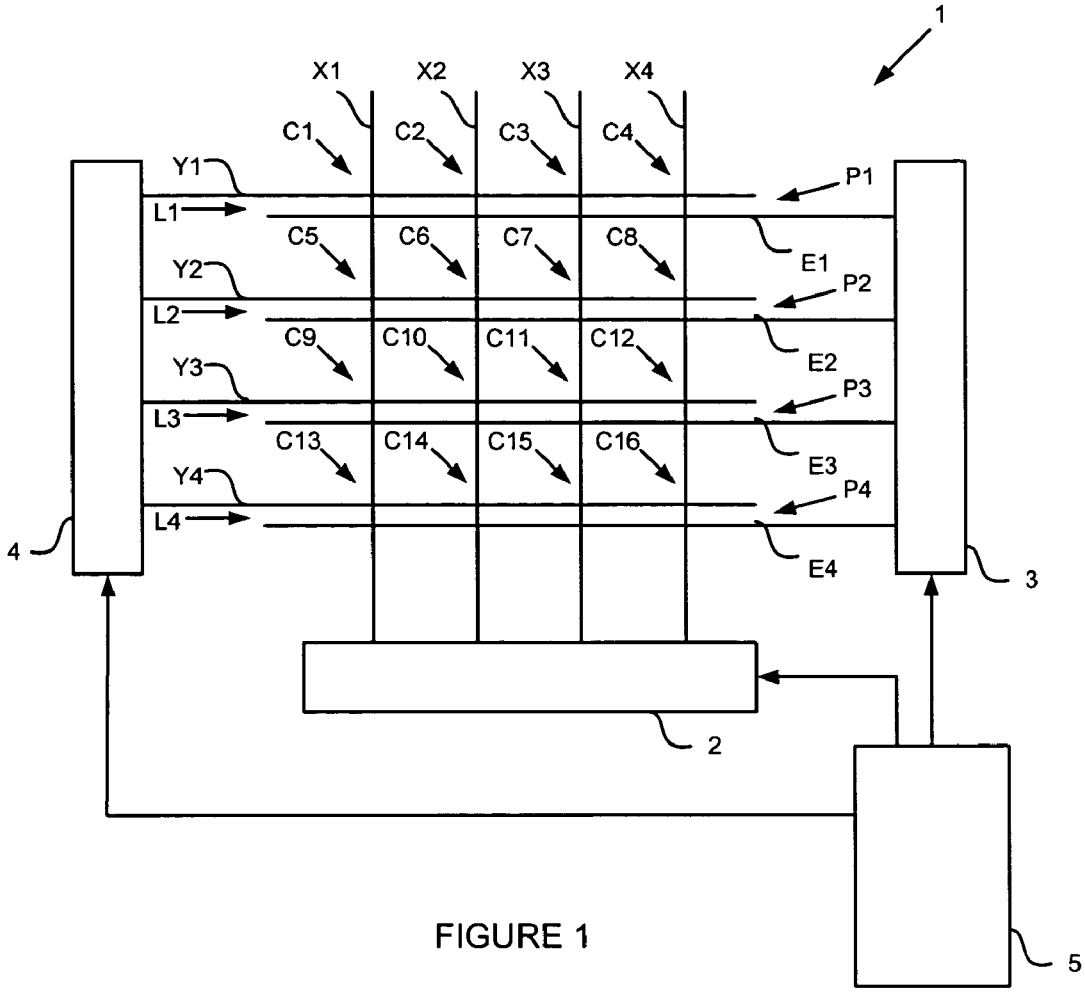
FIG. 1, already described, shows schematically a PDP to which the invention can be applied.

The operation and the structure of an AC coplanar-sustain PDP is explained below with reference to FIG. 1. The panel 1 comprises column electrodes X1 to X4 orthogonal to pairs P1 to P4 of sustain electrodes. Each intersection of a column electrode X1 to X4 with a pair of sustain electrodes P1 to P4 defines a cell C1 to C16 that defines a picture element, conventionally called a pixel. In the non-limiting example of the description, only four column electrodes X1 to X4 and only four pairs of sustain electrodes P1 to P4 have been shown, these forming four rows L1 to L4 of cells. However, the panel may, of course, have many more of these electrodes.

The column electrodes X1 to X4 are generally used only for addressing. They are each conventionally connected to a column driver 2.

The pairs of electrodes P1 to P4 each comprise an electrode called an address-sustain electrode Y1 to Y4 and an electrode called a sustain-only electrode E1 to E4. The address-sustain electrodes Y1 to Y4 fulfil an address function in cooperation with the column electrodes X1 to X4 and a sustaining function with the sustain-only electrodes E1 to E4. The sustain-only electrodes E1 to E4 are connected together and to a pulse generator 3 from which they all simultaneously receive cyclic voltage pulses for carrying out sustain cycles.

The address-sustain electrodes Y1 to Y4 are individualized and are connected to a line driver 5, from which they receive in particular, during a sustain phase, cyclic voltage pulses in synchronism with those applied to the sustain-only electrodes E1 to E4 but temporally shifted with respect to the sustain-only electrode pulses, and, during an address phase, base pulses in synchronism with signals applied to the column electrodes X1 to X4.

The synchronism between the various signals applied to the various electrodes is provided by a synchronizing device 6 connected to the drivers 2 and 5 and to the generator 3.

As indicated above, the operation of addressing a pixel of the PDP consists in simultaneously applying an address signal to the address-sustain electrode of this pixel and a data signal to its column electrode. A potential close to zero is also applied to the sustain-only electrodes.

Since the pixels of the PDP are addressed one after the other, this operation is repeated many times during display of an image. The capacitive energy transferred during these operations is high. The power transferred is a few tens of watts. By recovering this energy it is possible to reduce the size of the components, the heat-up and, consequently, the cost and power consumption of the PDP.

In the literature, the device intended to supply the drivers of the PDP is usually called a "line amplifier" when it is connected to the lines or rows of the PDP and a "data amplifier" when it is connected to the columns. Each row is addressed individually by applying a negative pulse to the corresponding address-sustain electrode via a line driver. The data amplifier is moreover so called since the addressing of the columns depends on the "data" defined by the content of the image to be displayed. All the columns are addressed individually and simultaneously with the addressing of each row.

Figure 2:
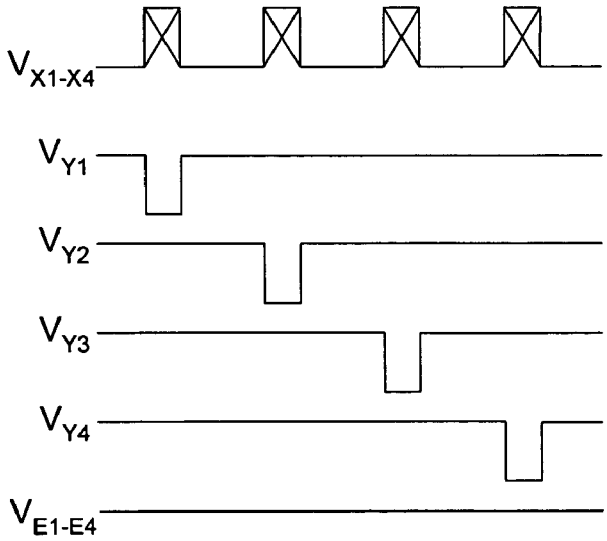
FIG. 2, already described, shows the signals conventionally applied to the row electrodes and the column electrodes of the PDP during an address phase.

The voltage signals applied to the pairs of sustain electrodes P1 to P4 and to the column electrodes X1 to X4 during the address phase are shown in FIG. 2. The rows L1 to L4 are addressed in succession by applying a negative voltage pulse to the corresponding address-sustain electrodes Y1 to Y4. A positive voltage pulse may or may not be applied to the column electrodes X1 to X4, depending on the data to be addressed (1 or 0). This positive voltage pulse is synchronized with the negative voltage pulse applied to the address-sustain electrode. It creates an electric field in the cell located at the intersection of the column electrode and the address-sustain electrode. As regards the signal applied to the sustain-only electrodes E1 to E4 during this phase, this is maintained at a low potential.

Currently, there are several devices for supplying the address-sustain electrodes or the column electrodes of the PDP during the phase of addressing the PDP cells. More generally, there are many devices for supplying the rows and columns of the PDP during the phase of addressing the cells of the PDP. The most common one is the circuit described in patent U.S. Pat. No. 4,866,349, usually called a Weber circuit by the name of its inventor. This circuit has, notably, four switches.

The invention therefore relates to a method of generating an address signal for addressing one or more rows or columns of a display panel comprising a plurality of rows and columns and cells arranged at the intersections of said rows and columns, which signal comprises voltage pulses of amplitude A and is selectively applied to one or more rows or columns of the display panel by means of a driver, characterized in that it comprises the following steps:

applying, for a first phase of duration T1, a first DC voltage across the terminals of a solenoid, so that the latter stores current in the form of magnetic energy, and a voltage of amplitude A across the terminals of the column(s) or row(s) selected by said driver;

discharging, during a second phase of duration T2, at least some of the energy stored in said solenoid into said column(s) or row(s) selected by said driver until the voltage across the terminals of said row(s) or column(s) becomes zero;

maintaining, during a third phase of duration T3, a zero voltage across the terminals of said column(s) or row(s) selected by said driver and optionally modifying said selection of the column(s) or row(s) during this phase;

charging, during a fourth phase of duration T4, the solenoid with the current stored in the form of capacitive energy into the capacitance formed between said column(s) or row(s) selected by said driver until the voltage across the terminals of said column(s) or row(s) is zero; and maintaining, during a fifth phase of duration T5, a zero voltage across the terminals of said capacitance formed between said column(s) or row(s) selected by said driver so as to create a write current in cells of the display panel.

During said first phase, the voltage of amplitude A applied to the terminals of the column(s) or row(s) selected by the driver is generated by summing said first DC voltage with a second DC voltage, the ratio of said first DC voltage to said second DC voltage being equal or very close to the ratio of the sum T2+T3+T4 to the sum T1+T5, and, for a solenoid of inductance L and a plurality of columns or rows of overall capacitance equal to C, the duration T2+T3+T4 is equal to $\pi\sqrt{LC}$.

According to a preferred embodiment, the method includes an additional phase of duration T6, after the fifth phase, corresponding to a rest phase during which no current is delivered to said column(s) or row(s) selected by said driver, the voltage across the terminals of said column(s) or row(s) being maintained with amplitude A.

The invention also relates to a device for implementing the method with five phases. It comprises:

a driver for selecting one or more columns or rows of the display panel;

a solenoid, a first end of which is connected to said column (s) or row(s) selected by the driver;

a first DC voltage generator, the negative terminal of which is connected to a second end of said solenoid and the positive terminal of which is connected to said first end of the solenoid via a first switching element, which first generator is intended to generate said first DC voltage V1, said first switching element being in the closed position during said first phase, in the open position during the next three phases and in the closed or open position during the fifth phase;

a second DC voltage generator, the positive terminal of which is connected to said second end of said solenoid and the negative terminal of which is connected to earth, which second generator is intended to generate said second DC voltage V2; and a first diode, the cathode and anode of which are connected to the first end of said solenoid and to earth, respectively.

The invention also relates to another device for implementing the method with six phases. It comprises:

a driver for selecting one or more columns or rows of the display panel;

a solenoid, a first end of which is connected to said column (s) or row(s) selected by the driver;

a first DC voltage generator intended to generate said first DC voltage V1, the positive terminal of which is connected to said first end of the solenoid via a first switching element and the negative terminal of which is connected, via a second switching element, to a second end of the solenoid, said first switching element being in the closed position during said first and sixth phases and in the open position during said second, third, fourth and fifth phases;

a second DC voltage generator, the positive terminal of which is connected to the negative terminal of said first DC voltage generator and the negative terminal of which is connected to earth, which second generator is intended to generate said second DC voltage; and a first diode, the cathode and anode of which are connected to the first end of said solenoid and to earth, respectively.

According to the invention, two devices are proposed for generating the signal to be applied to the columns or the rows (the address-sustain electrodes in the case of an AC coplanar-sustain PDP) during the phase of addressing the cells of the PDP.

Figure 3:
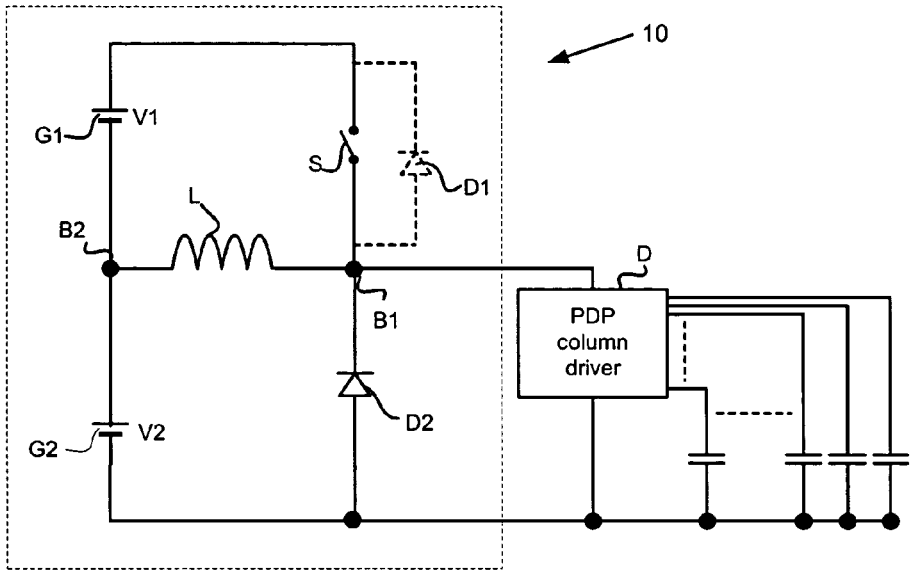
FIG. 3 shows a first device according to the invention capable of periodically generating pulses on the rows or columns of the PDP during the phase of addressing the cells of the PDP.
Figure 6:
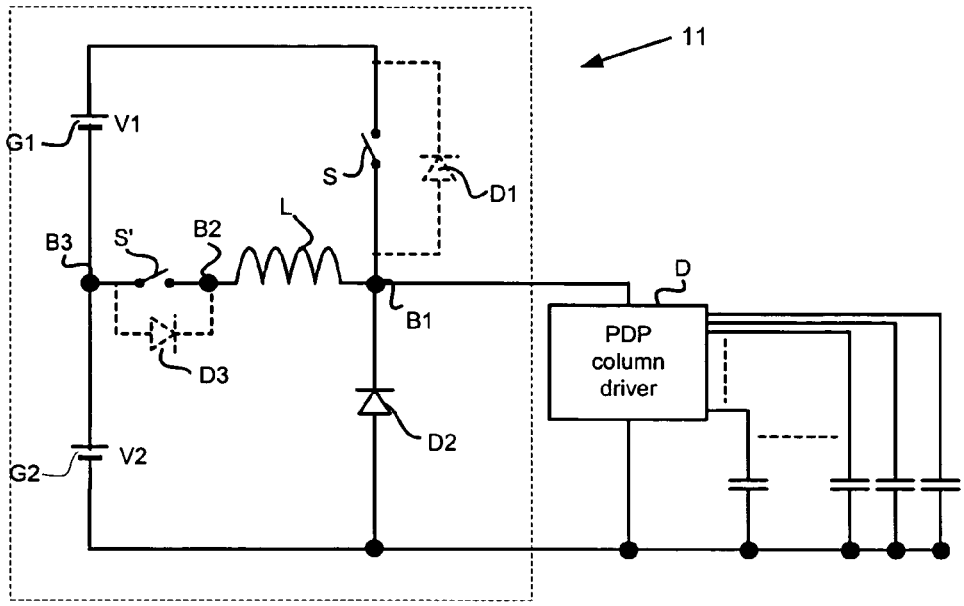
FIG. 6 shows a second device according to the invention.

The first device, illustrated by the diagram in FIG. 3, comprises a single switch and is more particularly suitable for supplying an approximately constant electric charge. The second device, illustrated by the diagram in FIG. 6, comprises two switches and is designed to supply a variable electric charge.

In the set of figures, the device according to the invention is connected to the columns or to a group of columns of a PDP via a column driver. The columns of the PDP are represented in these figures by their corresponding capacitors. The column driver selects the columns to be supplied according to the video data that it receives.

Referring to FIG. 3, the device, labelled 10, includes a solenoid L for storing magnetic energy and for discharging it into the capacitors corresponding to the columns of the PDP having a cell to be written.

The solenoid L is connected, via a first end B1, to said group of columns of the PDP via said driver, labelled D. The second end B2 of the solenoid is connected to the positive terminal of a voltage source G2 capable of delivering a DC voltage D2. The negative terminal of the source G2 is connected to earth. A diode D2 is also inserted between the end B1 of the solenoid and earth, with the cathode connected to the end B1 of the solenoid L.

A voltage source G1 capable of delivering a DC voltage V1 is connected to the terminals of the solenoid L via a switching element S having a switch function. The negative terminal of the source G1 is connected to the end B2 of the solenoid L and its positive terminal is connected to the switching element S. The latter is controlled by a control circuit (not shown in the figure). It is controlled so as to be placed either in the closed state, in which state the end B1 of the solenoid L is connected to the positive terminal of the voltage source G1, or in the open state. A diode D1 may be connected in parallel with the switch S, the cathode being on the same side as the positive terminal of the voltage source G1. This diode generally corresponds to the diode of the MOS transistor used as switch S. The voltages V1 and V2 and the duty cycle of the control signal for the switch S will be defined in an example given below.

Figure 4:
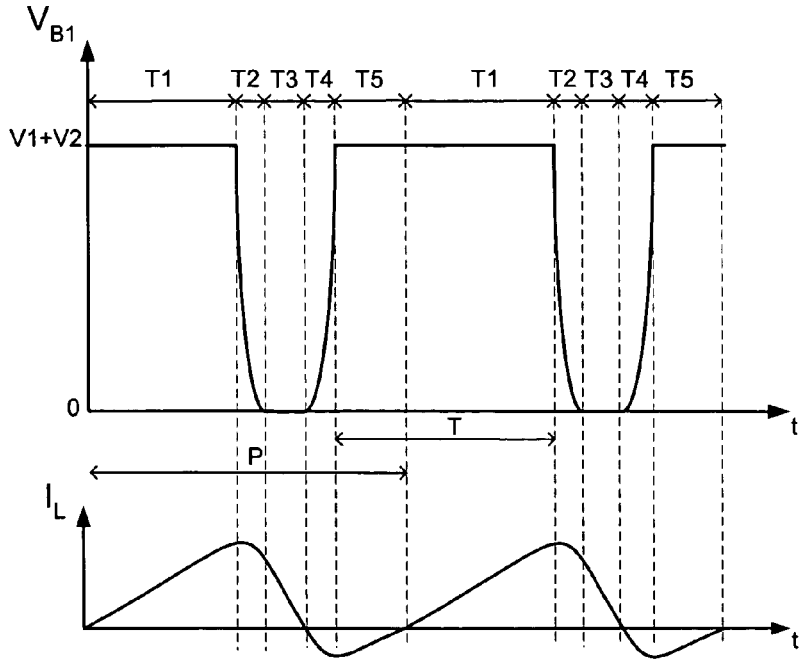
FIG. 4 shows the voltage signal generated by the device of FIG. 3 and the signal corresponding to the current flowing through a solenoid of the device of FIG. 3.

The operation of this device is illustrated by FIGS. 4 and 5A to 5E. The top and bottom parts of FIG. 4 show the waveform of the voltage delivered to the column driver and the waveform of the current flowing through the solenoid L of the generator, respectively. The pulses of the voltage signal delivered to the column electrodes of the PDP have an amplitude A=V1+V2, a duration T and a period P.

Figure 5A:
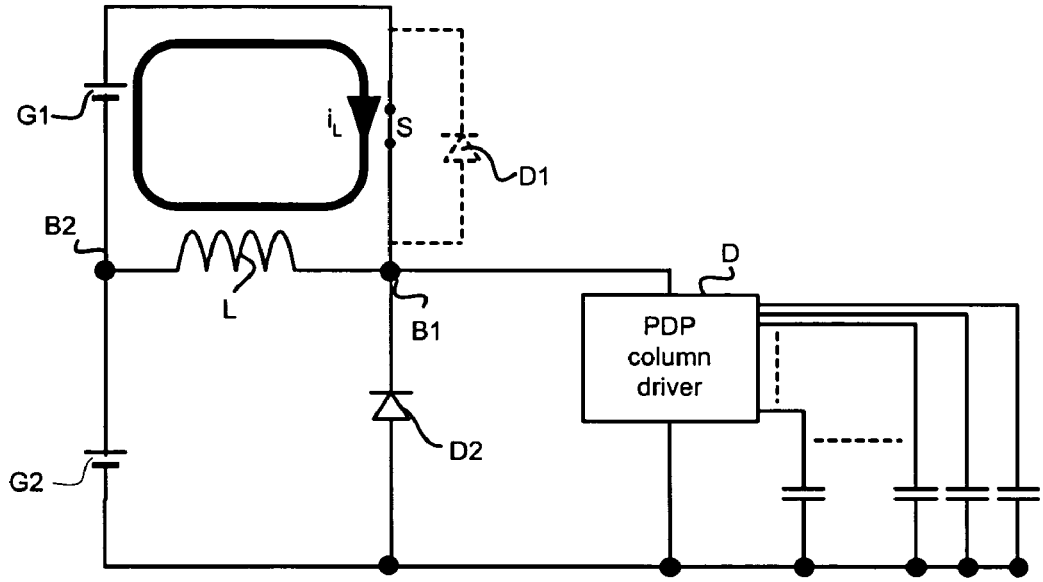
FIGS. 5A to 5E illustrate the operating phases of the device of FIG. 3.
Figure 5B:
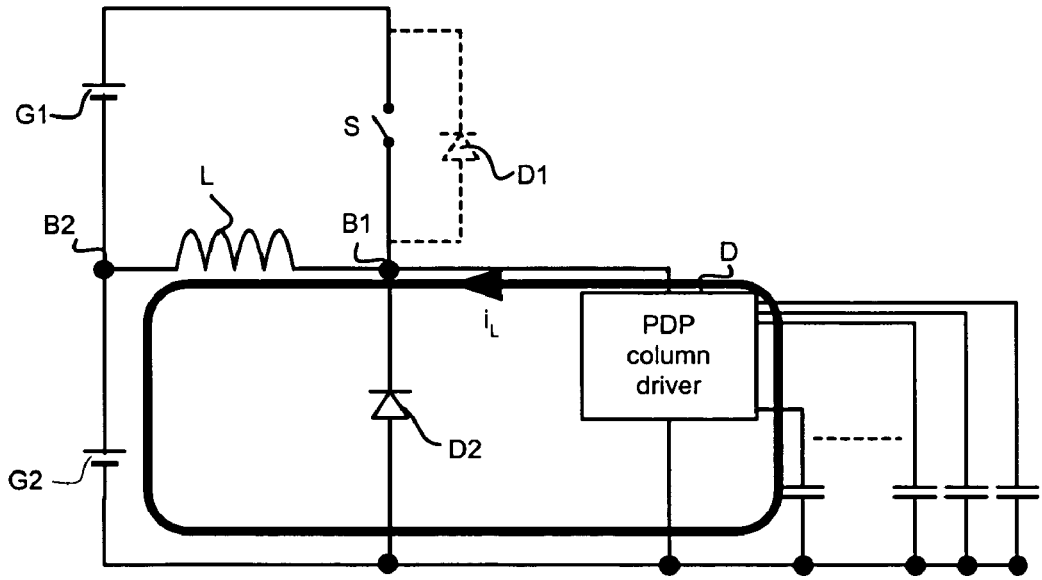
Figure 5C:
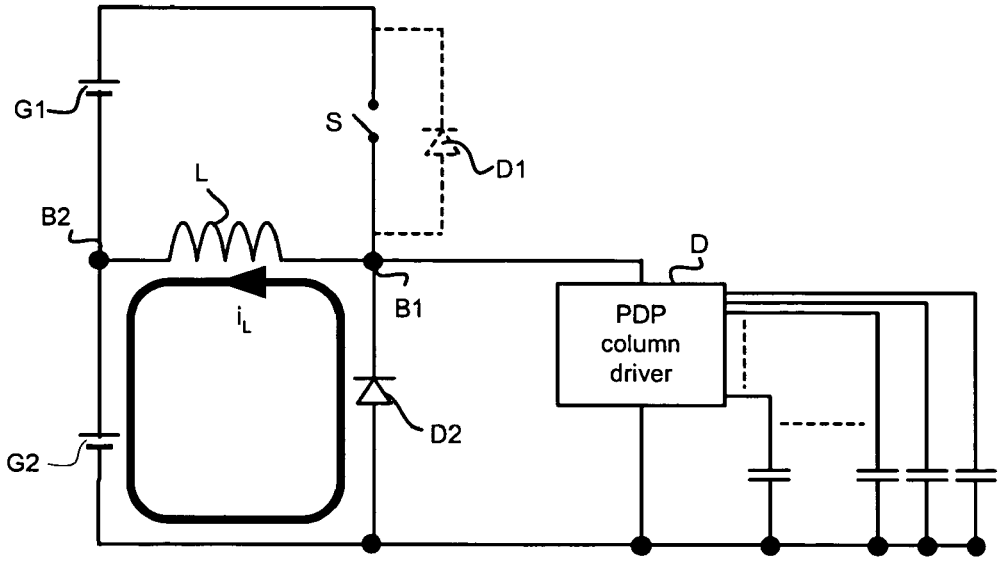
Figure 5D:
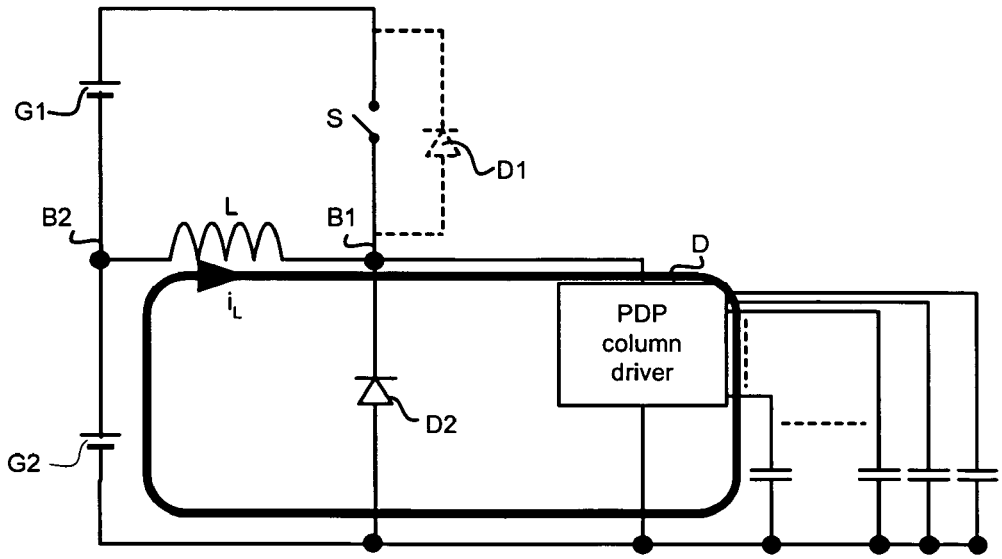
Figure 5E:
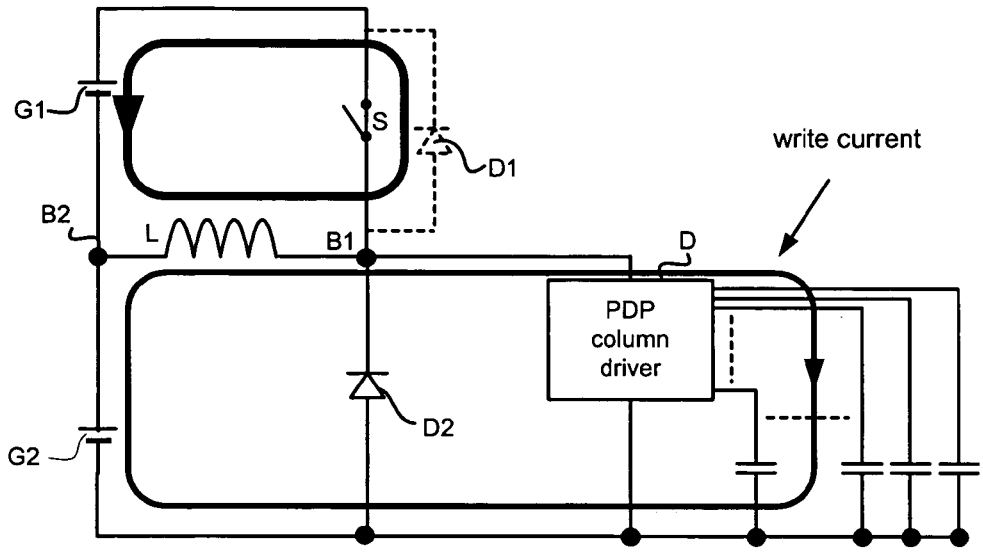

According to the invention, the method of generating this voltage signal comprises five phases:

- a first phase of fixed duration T1, illustrated by FIG. 5A, during which the solenoid L stores current in the form of magnetic energy and during which a voltage of amplitude A is applied to the terminals of the PDP columns selected by the driver D, the switches of the column driver being positioned in accordance with the data written during the previous signal period;
- a second phase of duration T2, illustrated by FIG. 5B, during which at least some of the current stored in the solenoid L is discharged into columns of the PDP that are selected by the column driver until the voltage across the terminals of these columns becomes zero;
- a third phase of duration T3, illustrated by FIG. 5C, during which the voltage across the terminals of the columns selected by the column driver is kept at zero and during which the state of the switches of the driver is modified in accordance with new data to be written; during this phase, the remaining portion of the current stored in the solenoid L is extracted from the latter and absorbed by the voltage source G2; since the amount of current absorbed by the voltage source G2 depends on the number of cells that are not written during the previous five-phase cycle, the duration of this phase also depends thereon;
- the fourth phase of duration T4, illustrated by FIG. 5D during which the solenoid L is charged with the current stored in the capacitors corresponding to the columns newly selected by the driver D until the voltage across the terminals of said columns reaches the amplitude A; and
- a fifth phase of duration T5, illustrated by FIG. 5E, during which the voltage across the terminals of the columns selected by the driver D is maintained at the amplitude A so that a write current flows through the cell to be written.

These phases are described below in greater detail.

Referring to FIG. 5A, the switching element S is placed in the closed state during the period of duration T1. A current $I_L$ flows through the circuit formed by the voltage source G1, the switching element S and the solenoid L. The intensity of the current $I_L$ increases in step with that stored in the solenoid L. Using the convention adopted for illustrating this method, the current $I_L$ is positive during this period. During this phase, the state of the switches of the driver D depends on the data written during the previous signal period. The voltage applied to the terminals of the capacitors corresponding to the column selected by the driver D is equal to A=V1+V2.

Referring to FIG. 5B, the switching element S is open during the period of duration T2. Some of the energy stored in the solenoid L is then discharged into the columns selected by the driver D until the voltage across the terminals of these columns is zero.

Referring to FIG. 5C, this voltage across the terminals of the PDP columns is kept at zero during the phase of duration T3. During this phase, the switching element S is maintained in the open state. Since the voltage is zero across the terminals of the PDP columns, the switches of the driver D are designed to operate during this phase, in accordance with video data newly delivered to the driver D. During this phase, the current remaining in the solenoid L after the phase T2 is absorbed by the voltage source G2 via the diode D2, as shown in the figure. This phase is effective until the current $I_L$ through the solenoid has become zero. This phase is preferably the shortest possible, as it is not necessary to address the cells of the PDP. It should also be noted that the duration T2+T3 is always constant, since, if the number of columns charged during the phase of duration T2 is small (short duration T2), the current remaining in the solenoid to be discharged into the voltage source G2 is high (long duration T3) and if the number of columns charged during the phase of duration T2 is large (long duration T2), the current remaining in the solenoid to be discharged into the voltage source G2 is low (short duration T3).

Referring to FIG. 5D, when the solenoid has been completely discharged the capacitive energy stored in the capacitors corresponding to the columns of the PDP is recovered in the solenoid L. The current $I_L$ then changes direction. During this phase of duration T4, the voltage across the terminals of the columns selected by the driver D rises up to the amplitude A=V1+V2. The switching element is maintained in the open state during this phase.

Finally, with reference to FIG. 5E, the voltage of amplitude A is maintained across the terminals of the columns selected by the driver D so that the write current flows through the cells to be written. Part of the energy stored in the solenoid is therefore discharged into the PDP cells to be written (i.e. the write current) and the other part is absorbed by the voltage source G1. This phase is effective until the current $I_L$ reaches zero. During this period, it does not matter whether the switching element is in the open state or the closed state since, if it is in the open state, the current $I_L$ flows through the diode D1.

The pulse of duration T and amplitude A produced in order to write a cell of the PDP is in fact generated by two cycles consisting of five phases, as described above. It is generated during the phase T5 of a first cycle and the phase T1 of the next cycle, as shown in FIG. 4.

The voltages V1 and V2, the durations T1, T2, T3, T4 and T5 and the inductance L of the solenoid are set by the following rules;

$$-\frac{V1}{V2} \approx \frac{T2+T3+T4}{T1+T5}$$

$$-V1+V2=A$$

$$-T2+T4 \approx \pi\sqrt{LC}$$

where C is the maximum capacitive charge for the group of columns controlled by the driver D.

Taking the following:

P=T1+T2+T3+T4+T5=1 μs,

T1+T5=4(T2+T3+T4),

C=6 nF (capacitance of the columns controlled by the driver D, corresponding for example to 1/27 of the columns of the PDP) and

A=V1+V2=100 V.

the following values are obtained: L≈1 μH, V1=20 V and V2=80 V.

This first embodiment uses a single switching element S to implement the method. It is preferably used for a constant capacitive charge, for example in a line amplifier. This is because, to improve the efficiency of this circuit, it is preferable to reduce to the maximum the duration T3 that generates losses. If the capacitive charge supplied by the device is constant, which is the case for a row to be addressed, it is then possible to size the inductance of the solenoid in order to minimize this phase. Since a negative pulse is required to address a row, the connection of the device to the row is inverted in order to convert the positive pulse into a negative pulse.

FIGS. 6, 7 and 8A to 8F illustrate a second embodiment of the device of the invention for implementing a method comprising six operating phases. This embodiment is shown in schematic form in FIG. 6. The device, labelled 11, differs from that of FIG. 3 in that it includes an additional switching element S' and an additional diode D3. The switching element S' is, for example, an MOS transistor and the diode D3 is the intrinsic diode of this transistor.

Figure 7:
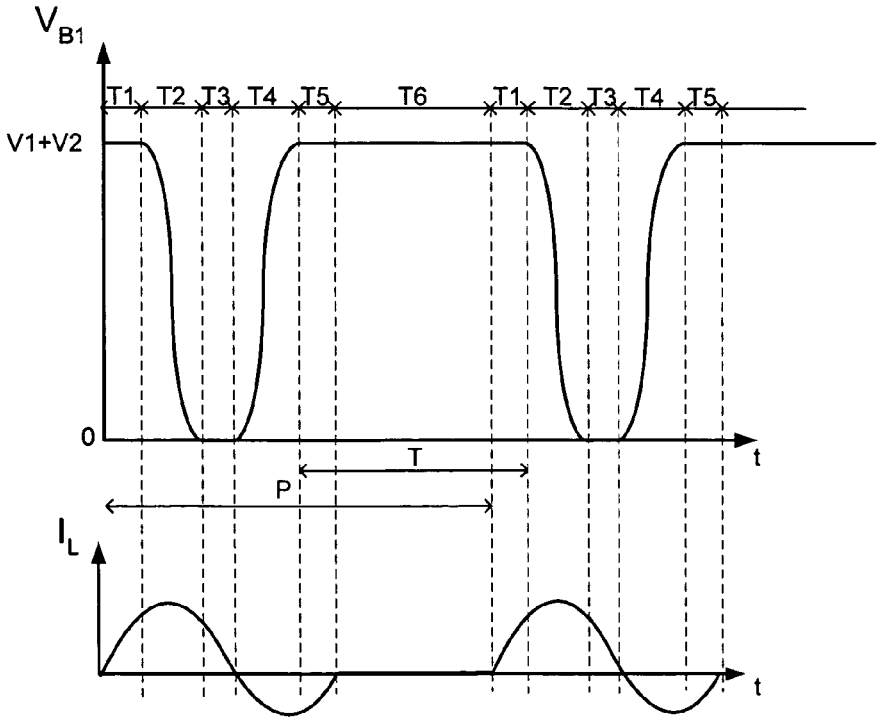
FIG. 7 shows the voltage signal generated by the device of FIG. 6 and the signal corresponding to a current flowing through a solenoid of the device of FIG. 6.

The switching element S' is inserted between the end B2 of the solenoid L and a point B3 corresponding to the positive terminal of the voltage source G2 and to the negative terminal of the voltage source G1. The diode D3 is connected in parallel with the switching element S', with the cathode on the same side of the end B2. With this device, the generation of the pulse signal includes an additional phase, namely an end-of-cycle rest phase, as illustrated in FIG. 7. To incorporate this new phase into the signal generation cycle, the duration T5 of the last phase of the signal is shortened and the sixth phase, of duration T6, corresponds to the remaining time of the period P of the signal.

The six signal generation phases are illustrated separately by FIGS. 8A to 8F. The first five phases illustrated by FIGS. 8A to 8E, respectively, are substantially identical to those of FIGS. 5A to 5E. An additional phase is added at the end of the cycle.

During the phase of duration T1 (FIG. 8A), the switching element S and S' are in the closed state. A current $I_L$ flows through the circuit formed by the voltage source G1, the solenoid L and the two switching elements S and S'. The current $I_L$ is positive during this phase. The voltage V1+V2 is applied across the terminals of the PDP columns selected by the driver D.

During the phase of duration of T2 (FIG. 8B), the switching element S' is maintained in the closed state and the switching element S is opened. Some of the energy stored in the solenoid L is discharged into the columns selected by the driver D until the voltage across the terminals of the columns is zero. More precisely, at the start of the phase, the solenoid L continues to receive energy, no longer from the voltage source G1 but from the capacitors corresponding to the columns of the PDP. The current therefore continues to increase slightly, before subsequently decreasing.

Figure 8A:
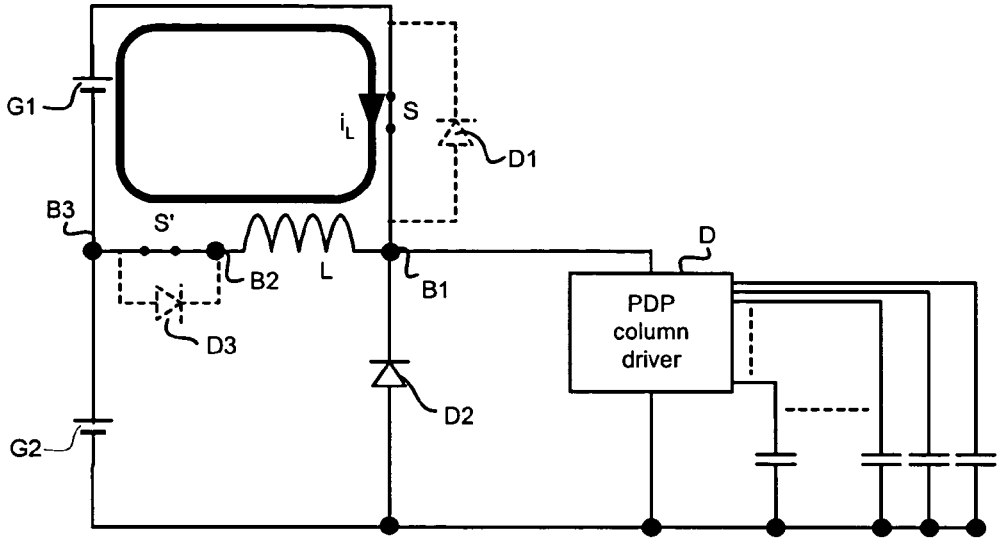
FIGS. 8A to 8F illustrate the six operating phases of the device of FIG. 7.
Figure 8B:
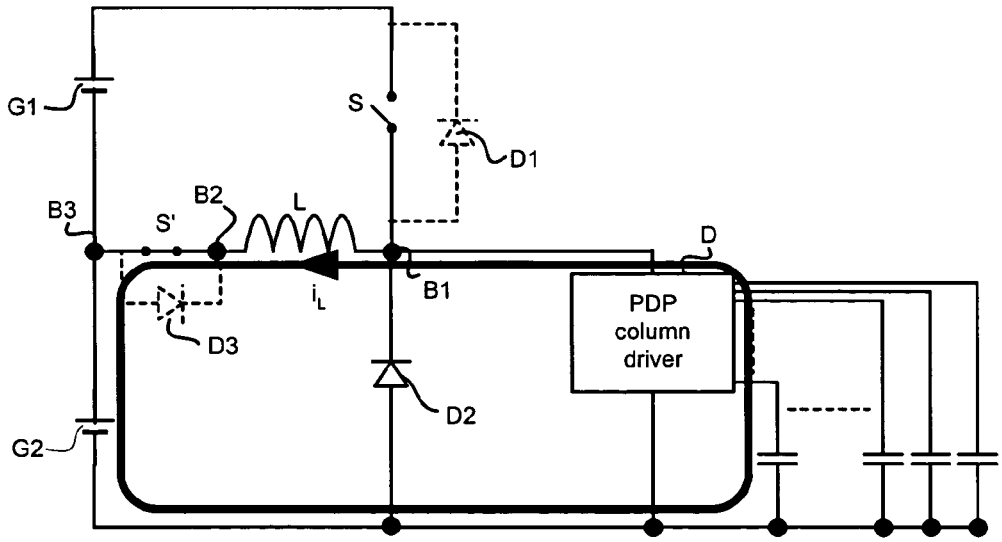
Figure 8C:
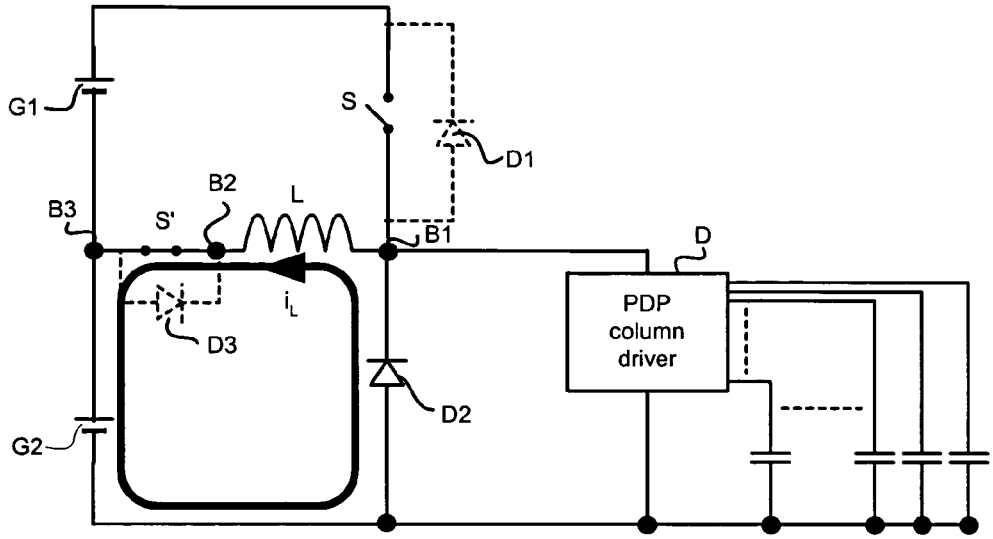

Referring to FIG. 8C, a zero voltage is maintained across the terminals of the PDP columns during the next phase of duration T3 until the current $I_L$ through the solenoid becomes zero. During this phase, the state of the switching elements S and S' is unchanged. However, the switches of the driver D are operated depending on the cells to be written during the cycle. The remaining part of the current stored in the solenoid L is absorbed by the voltage source G2 via the diode D2. As previously, the duration of this phase is reduced to the maximum so as to improve the efficiency of the device.

Figure 8D:
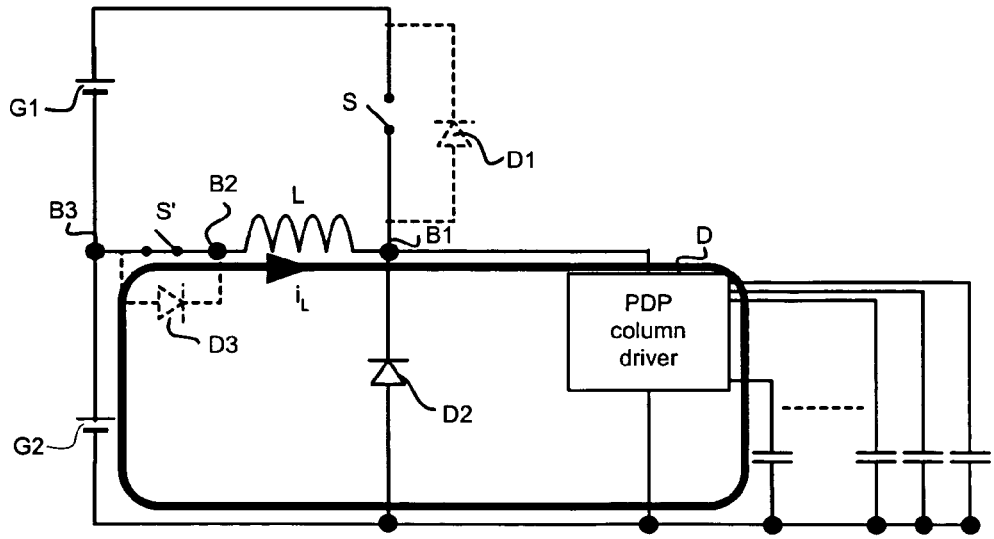

During the next phase of duration T4, illustrated by FIG. 8D, the capacitive energy stored in the columns of the PDP cells to be written is recovered in the solenoid L. The current $I_L$ then changes direction. The voltage across the terminals of the PDP columns again increases until it reaches the amplitude V1+V2. During this phase, this state of the switching elements S and S' is unchanged with respect to the previous phase. The durations T2 and T4 are substantially equal.

Figure 8E:
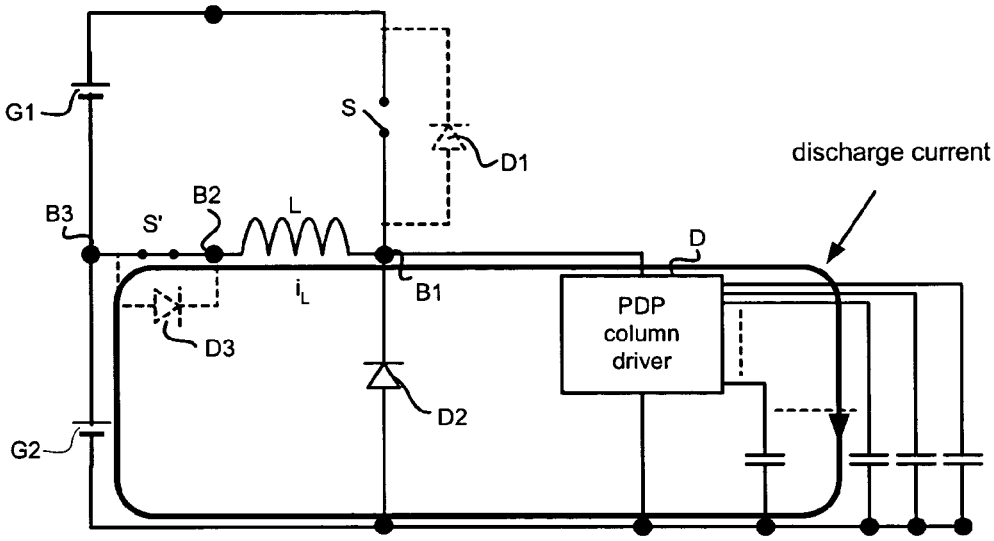

When the voltage across the terminals of the columns of the cells to be written reaches the amplitude V1+V2, a write current is generated in said cells in order to write them, as shown in FIG. 8E. It does not matter whether the switching elements S and S' are in the open position or the closed position during this phase of duration T5. This is because if the switching element S' is open, the write current for the cells flows through the circuit formed by the cell, the driver D, the solenoid L, the diode D3 and the voltage source G2. Otherwise, the current flows via the switching element S' instead of the diode D3.

Advantageously, the state of the switching elements S and S' during the phase of duration T4 is maintained at the start of the phase of duration T5. After the phase of duration T5, the switching element S is closed and the switching element S' is opened, for the purpose of the next phase.

Figure 8F:
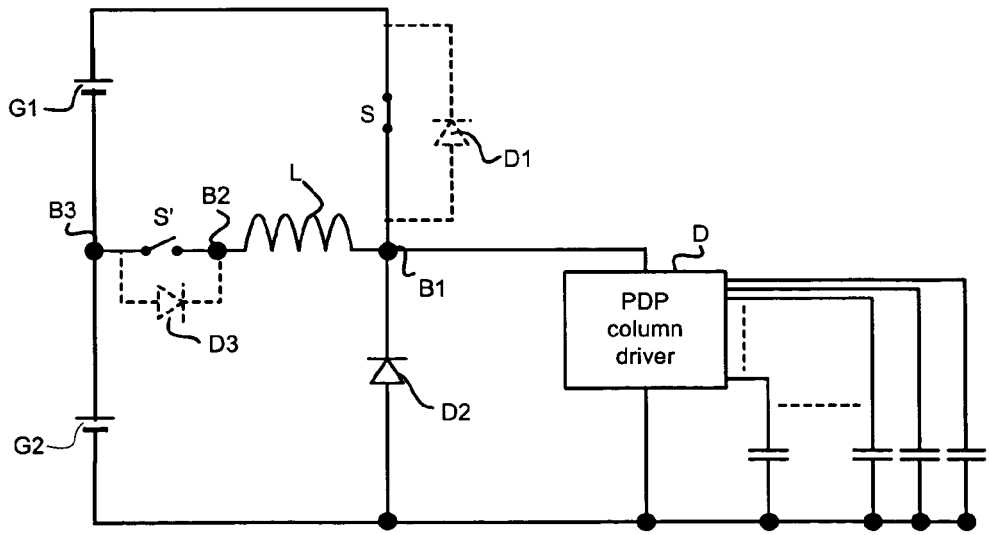

The next phase of duration T6 is a rest phase and is illustrated by FIG. 8F. No current is flowing. The voltage across the terminals of the PDP columns comprising written cells is maintained at V1+V2. This additional phase has the purpose of improving the efficiency of the device since the conduction losses are zero. The improved efficiency is obtained for a minimum reactive energy transfer, i.e. for V1=V2. In practice, it is beneficial for the surplus energy corresponding to the operating losses to be stored in L. Consequently, these losses will be minimal for V1 slightly less than V2.

$$\text{If } T2+T4=2\pi\sqrt{LC}, \text{ then } L=\frac{1}{C}\left(\frac{T2+T4}{2\pi}\right)^2.$$

Thus, for a maximum column capacitance of 6 nF, a maximum energy recovery time of 500 ns, and V1≈V2, then:

$$L=\frac{1}{6\times10^{-9}}\left(\frac{500\times10^{-9}}{2\pi}\right)^2=1\ +\mu\text{H}$$

This value is valid whatever the duration of the rest phase of duration T6. With these values, the duration of a write cycle must in practice be greater than 1 μs (500 ns of recovering time and 500 ns of write time).

This second embodiment uses two switching elements S and S'. It is therefore slightly more expensive to produce than the first device. However, it can be used for a variable or constant capacitive charge. It can therefore be employed in a data amplifier or a line amplifier.

The durations T1 and T2 depend on the data written during the previous cycle. During T1, energy is stored in the coil and during T2 this is discharged into the columns of the PDP. The ratio T1/T2 must therefore be approximately constant. The more the energy stored during T1, the longer the duration T2 for discharging it.

The main advantage of these devices lies in their low production costs since they comprise only one or two power switches serving as switching elements compared with three or four in the known devices. Moreover, these switches can be controlled by low-voltage signals.

The invention claimed is:

1. A method of addressing a display panel comprising the steps of:

providing a driver for selectably addressing individual cells of said display panel by applying voltage across corresponding terminals of columns and rows of said panel;

applying, for a first phase of duration T1, a first DC voltage across the terminals of a solenoid, so that the latter stores current in the form of magnetic energy;

selectably addressing at least one individual cell of said display panel;

discharging, during a second phase of duration T2, at least some of the energy stored in said solenoid into said column(s) or row(s) selected by said driver until the voltage across the terminals of said row(s) or column(s) becomes zero;

maintaining, during a third phase of duration T3, a zero voltage across the terminals of said column(s) or row(s) selected by said driver and optionally modifying said selection of the column(s) or row(s) during this phase;

charging, during a fourth phase of duration T4, the solenoid with the current stored in the form of capacitive energy into the capacitance formed between said column(s) or row(s) selected by said driver until the voltage across the terminals of said column(s) or row(s) reaches a given amplitude; and maintaining, during a fifth phase of duration T5, the given voltage amplitude across the terminals of said capacitance formed between said column(s) or row(s) selected by said driver so as to create a write current in cells of the display panel.

2. The method according to claim 1, wherein; during said first phase, generating; the given voltage of amplitude & applied to the terminals of the column(s) or row(s) selected by the driver by summing said first DC voltage with a second DC voltage, the ratio of said first DC voltage to said second DC voltage being equal or very close to the ratio of the sum T2+T3+T4 to the sum T1+T5, and in that, for a solenoid of inductance equal to L and a plurality of columns or rows of overall capacitance equal to C, the duration T2+T3+T4 is equal to $\pi\sqrt{LC}$.

3. The method according to claim 1, further comprising the step of, during an additional phase, after the fifth phase, corresponding to a rest phase during which no current is delivered to said column(s) or row(s) selected by said driver, maintaining the voltage across the terminals of said column (s) or row(s) with the given voltage amplitude.

4. The method according to claim 2, wherein the first and second DC voltages are generated by first and second DC voltage generators, respectively.

5. The method according to claim 4, wherein, during a phase of duration T3, the current remaining in the solenoid is absorbed by the second DC voltage generator in order to eliminate the current stored in said solenoid.

6. A device for addressing a display panel, comprising:

a driver for selecting columns and rows of the display panel;

a solenoid, coupled to column(s) and row(s) selected by the driver;

a first DC voltage generator, coupled to said solenoid via a first switching element, said first switching element switchable between an open and closed position depending on phase;

a second DC voltage generator, coupled to said solenoid which second generator generates said second DC voltage; and a first diode, coupled to said solenoid.

7. A device for addressing a display panel, comprising:

a driver for selecting one or more columns or rows of the display panel;

a solenoid, coupled to said column(s) or row(s) selected by the driver;

a first DC voltage generator intended to generate said first DC voltage, the positive terminal of which is connected to said first end of the solenoid via a first switching element and the negative terminal of which is connected, via a second switching element, to a second end of the solenoid, said first switching element being in the closed position during said first and sixth phases and in the open position during said second, third, fourth and fifth phases;

a second DC voltage generator, the positive terminal of which is connected to the negative terminal of said first DC voltage generator and the negative terminal of which is connected to ground, which second generator is intended to generate said second DC voltage; and a first diode, the cathode and anode of which are connected to the first end of said solenoid and to said ground, respectively.

* * * * *